US009326588B2

(12) United States Patent
Jones

(10) Patent No.: US 9,326,588 B2
(45) Date of Patent: May 3, 2016

(54) CARRYING AID

(71) Applicant: Jason V. Jones, Lancaster, PA (US)

(72) Inventor: Jason V. Jones, Lancaster, PA (US)

( * ) Notice: Subject to any disclaimer, the term of this patent is extended or adjusted under 35 U.S.C. 154(b) by 280 days.

(21) Appl. No.: 13/958,555

(22) Filed: Aug. 3, 2013

(65) Prior Publication Data

US 2015/0035305 A1 Feb. 5, 2015

(51) Int. Cl.
*A45F 5/10* (2006.01)

(52) U.S. Cl.
CPC ..... *A45F 5/10* (2013.01); *A45F 5/1046* (2013.01); *A45F 2005/1006* (2013.01); *A45F 2005/1093* (2013.01)

(58) Field of Classification Search
CPC . A45F 2005/1073; A45F 5/10; A45F 5/1026; A45F 5/1046; A45F 2005/1006; A45F 2005/1093; A45C 13/26; B65D 71/0003; A63C 11/025; B65G 7/12; B25G 3/32; A47J 45/071
USPC ..... D9/434, 455
See application file for complete search history.

(56) References Cited

U.S. PATENT DOCUMENTS

| | | | | | |
|---|---|---|---|---|---|
| 2,501,037 | A * | 3/1950 | Fox | ..... | 294/158 |
| 4,262,385 | A * | 4/1981 | Norman | ..... | 16/411 |
| 4,930,543 | A * | 6/1990 | Zuiches | ..... | 138/110 |
| 5,257,845 | A * | 11/1993 | McConnell | ..... | 294/171 |
| 6,378,925 | B1 * | 4/2002 | Greenlee | ..... | 294/171 |
| D502,872 | S * | 3/2005 | Fleming | ..... | D9/434 |
| D513,962 | S * | 1/2006 | Beckwith | ..... | D8/322 |

* cited by examiner

*Primary Examiner* — Stephen Vu
(74) *Attorney, Agent, or Firm* — Steven O'Donnell

(57) ABSTRACT

A carrying aid for t-shirt bags (aka plastic grocery bags) and other similar bags is disclosed. When carried without the use of some assistive device, the weight of the bags can cause an unpleasant cutting sensation across the user's fingers. This device wraps around the bags' handle loops and reversibly attached to itself forming a flattened tube containing the handles. The carrying aid cushions the finger stress caused by the bags and keeps the bags linked together when placed down. A strip of a rigid material may be included to further distribute the bags' weight. Further, the carrying aid may be imprinted with advertising or loyalty program insignias, and may also be linked by a carabineer or similar. The device can be removed and reused as needed.

1 Claim, 4 Drawing Sheets

CARRYING AID

FIELD OF THE INVENTION

The subject matter of this application relates to a device for easing the difficulties of in carrying plastic t-shirt bags such as those often used to transport groceries and other goods. It comprises a piece of material that can be wrapped around the handles of multiple such bags to hold them together and that aids in distributing the weight of the load across the fingers of the carrier. When in use, the device reversibly attached to itself, forming a flat tube surrounding the bags' handles. The device may further comprise a support to further distribute the weight of the load, and may have a hole suited for holding a keyring or carabiner. Advertising or computer-readable codes may also be present on the device.

BACKGROUND

Those of a certain age may remember a time when groceries were always bagged at a grocery store checkout lane by a person whose whole job it was to pack groceries in the cuboid shape of a paper grocery bag, striking a balance between maximal use of the available space and making the final bag capable of being carried by the customer.

Times change, and stores gradually started to shift to cheaper plastic bags (often called t-shirt bags in the industry because of their shape prior to use). The question "paper or plastic" was asked thousands of times per day by bag-boys around the country. Some people, defeating the whole purpose of stores purchasing the lower cost plastic bags, would have a paper bag inserted into a plastic bag to have the structural support of a paper bag, and the convenient handles of a plastic bag.

Gradually, stores pushed harder to eliminate the paper bag option, some by charging a small amount for a paper bag while others would have convenient "shortages" of paper bags.

Eventually, paper bags became rarities, and eventually all but disappeared from the grocery store landscape, although their legend lives on, if no where but these last few paragraphs.

To a grocery store patron, the primary advantage of a t-shirt bag are the handles. The handles, however, lure the end user into carrying more heavily packed bags that can stress the grasp of the fingers coiled around them; the presence of handles also tempts the patron to carry more bags in each hand than may be prudent.

The plastic used for these bags (usually HDPE—High Density Polyethylene) is also carefully engineered to be as thin as possible while still achieving some minimum levels of tensile strength and tear resistance. Unfortunately, this also means that the bags themselves have very little structural stability and tend to fall over when placed down, potentially allowing some of it's cargo to slip loose and become wedged in hard to reach areas of the trunk of the consumer's car. A number of aids are known in the art that assist a person in carrying such grocery bags.

One such carrier is disclosed in U.S. Pat. No. 6,062,622 in which a plastic loop with a flattened finger-area is used to clasp one or more bags.

Another carrier design is disclosed in U.S. Pat. No. 6,056,344. That design comprises a disposable piece of material that can loop around the handles oft-shirt bags and that is held in place by interlocking ridges. Another design of a device for holding these types of bags is disclosed in U.S. Pat. No. D480,645.

A common theme in the art is that of a some number of closed or open hooks on a rigid handle. Examples of this general theme can be found in U.S. Pat. Nos. 6,347,822, D441,651, D440,492, D410,386, D380,670, D362,622, D336732, D137,712, 6,651,941, and 6,347,822.

The above is not meant to be an exhaustive listing of prior art patents, but merely demonstrative of the types of patents concerning carrying aids for t-shirt bags. Other art likely exists.

Although these carrying aids may be useful to some, they also have certain disadvantages. Many are inflexible and large enough that carrying them may be more of a bother than foregoing their use. Some of these also have pointed tips that could introduce other problems such as puncturing the bags intended to be carried, and possibly puncturing the user. Others, such as U.S. Pat. No. 6,056,344 are not meant to be reused and may not provide much meaningful protection from the bag handles. Further, due to their design, such carrying aids may not hold together, or hold onto the bag handles, when the bags are set down.

SUMMARY

The subject matter of this application is a carrying aid for plastic bags with loop handles such as those often used for carrying groceries or other goods ("t-shirt bags"). More particularly, the subject matter of this invention pertains to a carrying aid comprising a rectangular piece of material of a certain resilience and having a sufficient cushioning quality such that it can be wrapped around the handles of one or more t-shirt bags.

In use, the carrying aid is reversibly secured around the handles of the bags with a securing means. The inherent cushioning quality of the material reduces the stress placed on the carrier's fingers by distributing the weight across the carrying aid.

The unfurled carrying aid may be of an appropriate size to fit within a wallet. It may also further comprise a hole through which a carabineer or key ring may be placed to allow the carrying aid to be attached to other items such as the strap of a satchel, keys, or a customer loyalty card. An additional thin layer of material may be bonded to the top of bottom surfaces of the carrying aid and printing may be applied to either this additional piece of material, or to the carrying aid without such additional material. This printing may be purely decorative, contain a computer readable code such as a bar code or a QR code, or similar, or contain advertising. Further, an additional piece of rigid material, such as a strip of minimally flexible plastic, may be bonded to the carrying aid, or placed within the carrying aid, to increase the cushioning and weight distribution properties of the carrying aid.

DETAILED DESCRIPTION OF THE PREFERRED EMBODIMENTS

Figure 1:
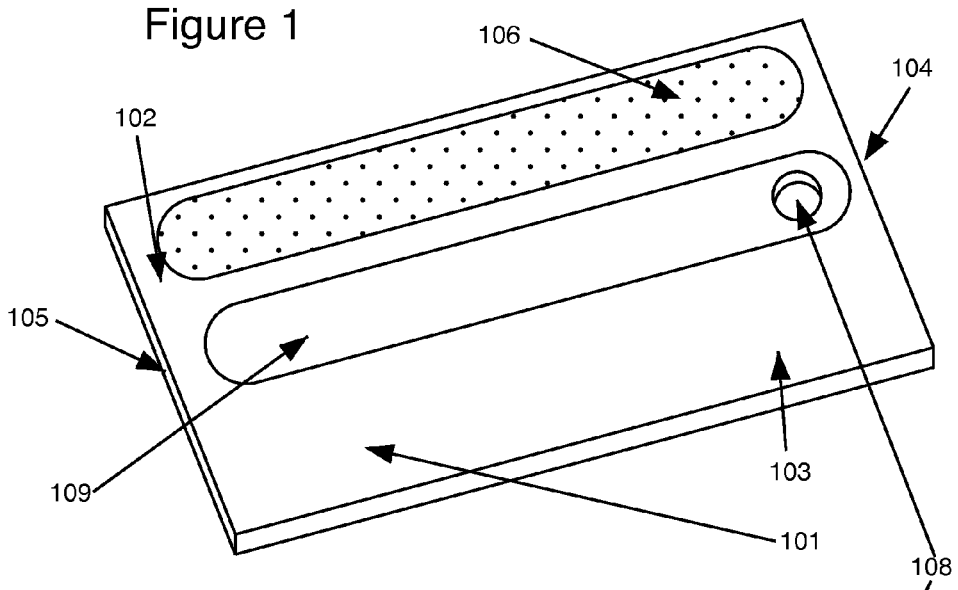
FIG. 1 is an illustration of the carrying aid as seen from the top.
Figure 2:
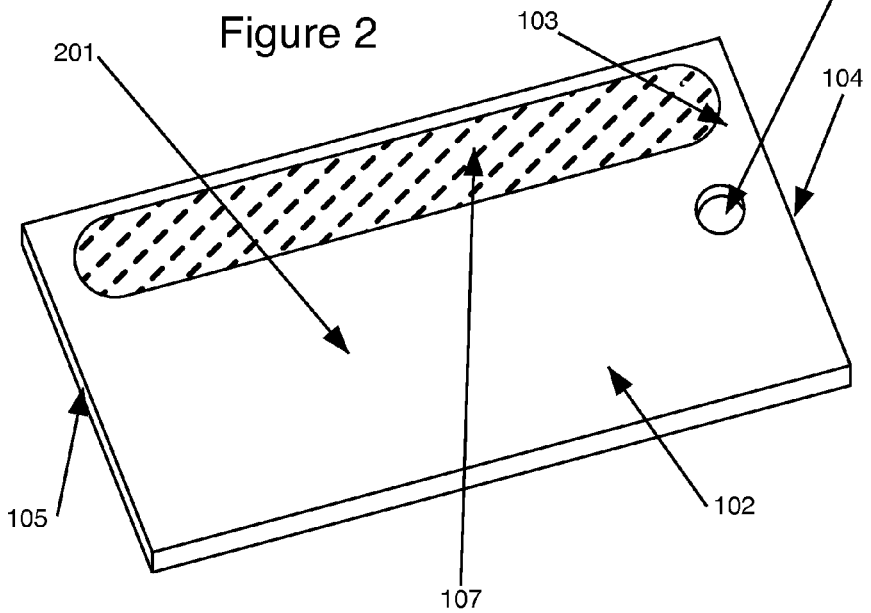
FIG. 2 is an illustration of the carrying aid as seen from the bottom.
Figure 3:
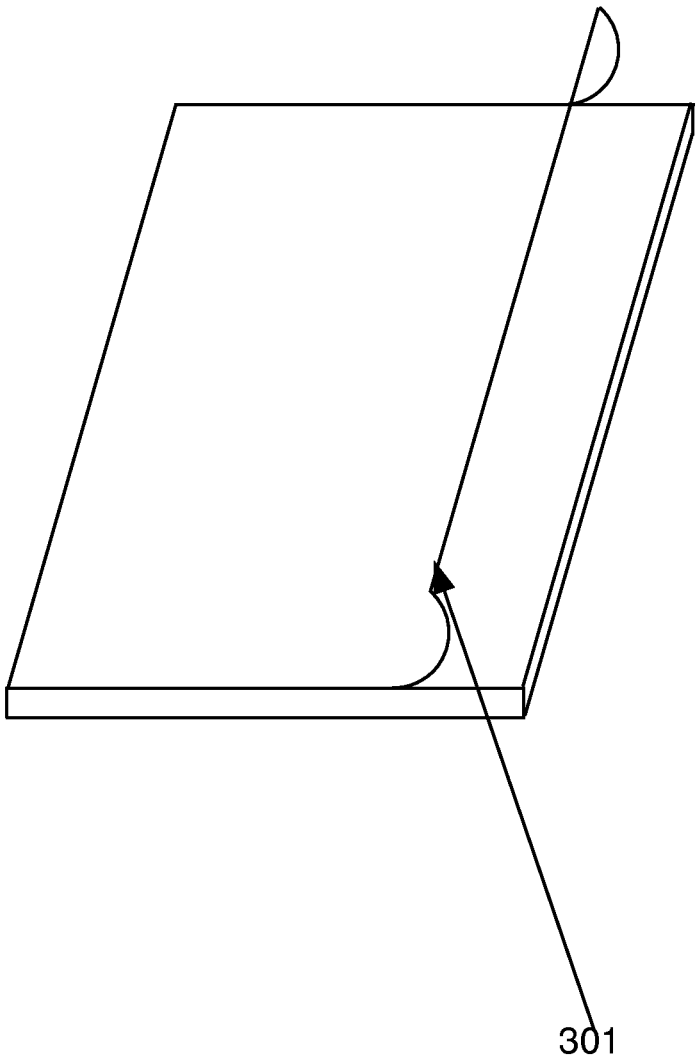
FIG. 3 is an illustration of the carrying aid further comprising an overlay of material.

The following description and drawings referenced therein illustrate embodiments of the application's subject matter.

They are not intended to limit the scope. Those familiar with the art will recognize that other embodiments of the disclosed method are possible. All such alternative embodiments should be considered within the scope of the application's claims.

Each reference number consists of three digits. The first digit corresponds to the figure number in which that reference number is first shown. Reference numbers are not necessarily discussed in the order of their appearance in the figures.

This application discloses a carrying aid that reduces the cutting stress placed on a user's fingers when carrying certain items, particularly plastic grocery bags a/k/a t-shirt bags, however the disclosed subject matter may be used with any container with handles. Therefore, the claims should not be interpreted to pertain to a carrying aid only suited for use with plastic grocery bags. Accordingly, the term "t-shirt bag" shall encompasses not only plastic grocery bags, but also any bag, satchel, or other carrying item comprising one or more loop handles. The disclosed carrying aid also reversibly secures the handles of one or more t-shirt bag handles.

The carrying aid has a top face (101) and a bottom face (201). The carrying aid also has a midline longitudinal axis that defines a left side (102) and a right side (103). Additionally, the carrying aid has a front side (104) and a back side (105) that are perpendicular to the carrying aid's longitudinal axis. Preferably, the carrying aid is rectangular and the front side and the back side are along the shorter sides of the rectangle. The carrying aid's left side and right side comprise edges defining the two long sides of the rectangle. Certainly, the exact shape of the carrying aid may be different and alternative shapes should be considered within the scope of the claims. As used, 'largely rectangular' should be understood to comprise planar shapes having a longitudinal axis longer than its transverse axis.

In preferred embodiments, the body of the carrying aid is constructed out of material of sufficient cushioning ability to reduce the cutting stress on the user's fingers caused by the weight of the t-shirt bag handles. For example, materials such as leather or those comprising a layer of neoprene are well-suited for this application.

The carrying aid further comprises a reversible securing means that can attach the carrying aid's said left side and said right side. When the securing means is not engaged, the carrying carrying aid lies flat, but when the securing means are engaged, the carrying aid forms a flattened tube from the otherwise planar carrying aid.

Figure 4:
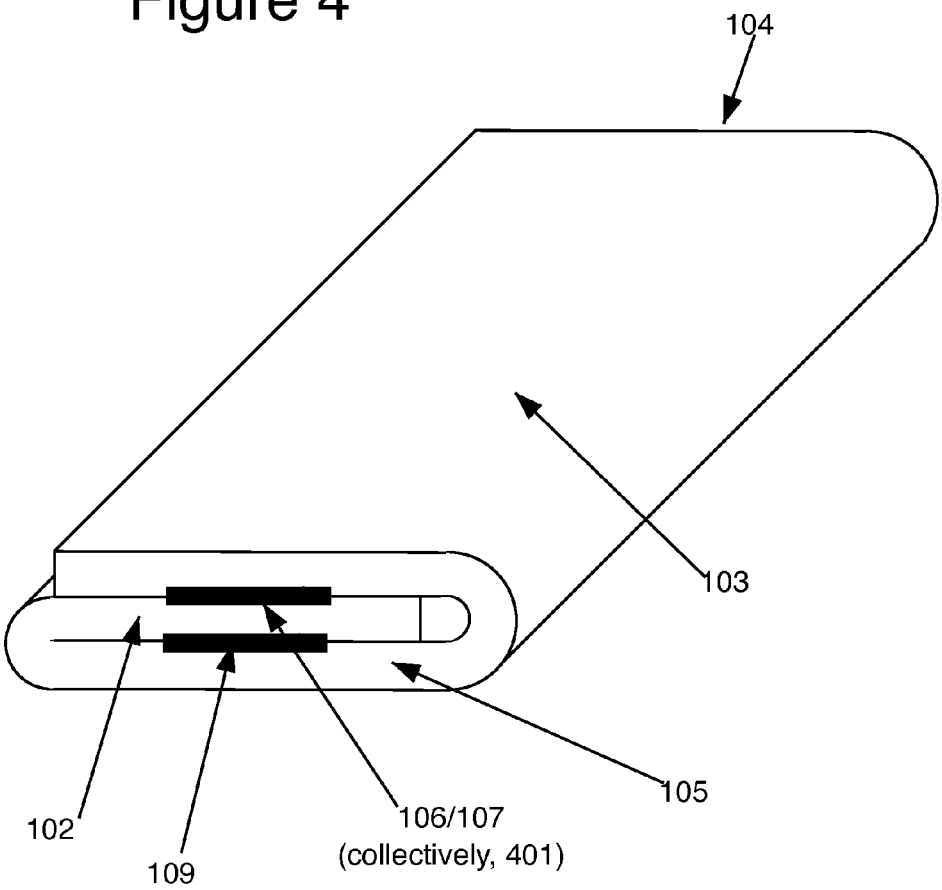
FIG. 4 is an illustration of an embodiment of the carrying aid as folded as it would be in use.
Figure 5:
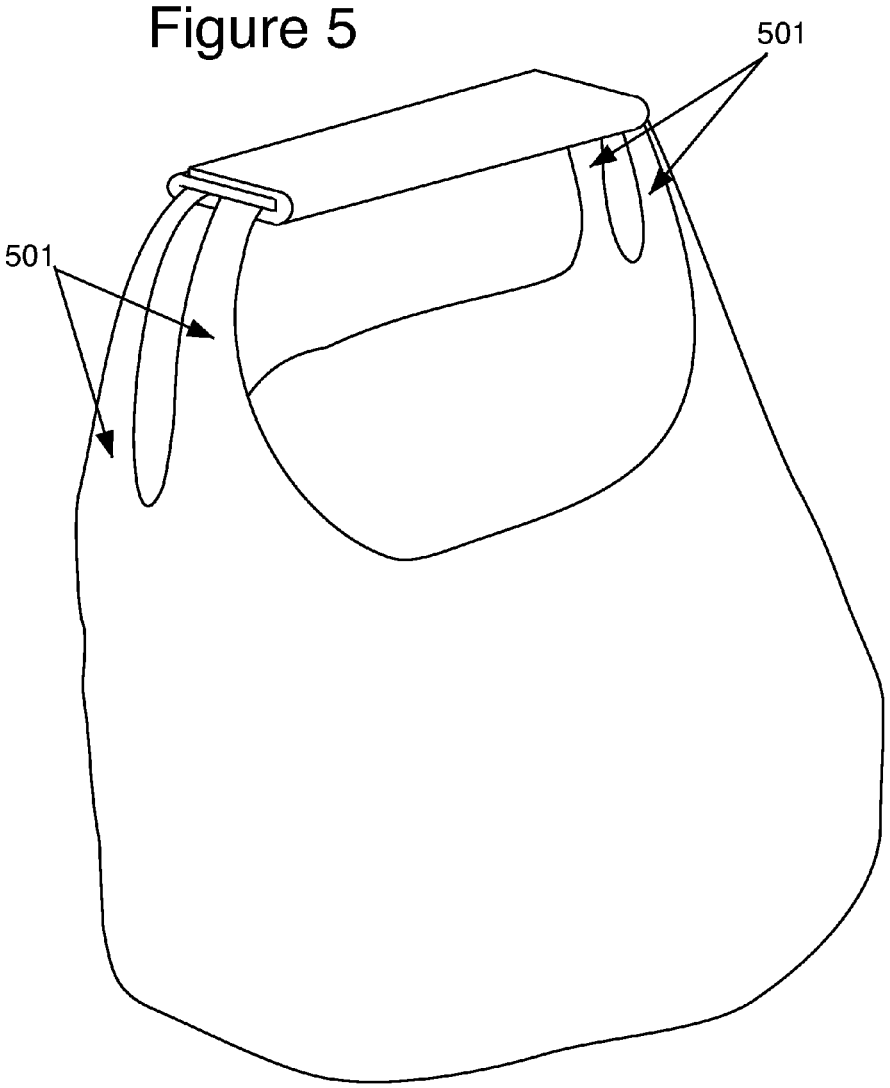
FIG. 5 is an illustration of an embodiment of the carrying aid wrapped around the handle loop of a bag.

In a most preferred embodiment, the reversible securing means is a hook and loop connector. In one such embodiment, one half of the hook and loop connection system is located along the longitudinal axis on the left side of the carrying aid's top face (106) and the other half of the hook and loop connector is located along the longitudinal axis on the right side of the carrying aid's bottom face (107). Of course, one with any familiarity in the art will readily appreciate that the hook and loop connectors can be moved from the disclosed positions without affecting the utility of the carrying aid and one such alternative positioning of the securing means is shown in FIG. 4. Further, other reversible securing means, such as clothing snaps, buckles, and magnets could be used instead of a hook and loop system.

Another embodiment of the carrying aid further comprises at least one hole traversing the carrying aid (108), and located near the edge of either the carrying aid's top side, or the carrying aid's bottom side. This hole may allow the carrying aid to be placed on a hook when not in use, or may hold a carabiner or key ring.

Further, the carrying aid may optionally comprise an additional strip of a material having a greater resilience than the material forming the basic carrying aid (109). This additional strip of material is preferably a rigid plastic, but other materials may be suitable. If present, this strip of material is located along the midline longitudinal axis and extends from near the back end of the carrying aid to near the front end of the carrying aid. The width of this additional strip is less than one third of the width of the carrying aid as measured from the outer edge of the left side to the outer edge of the right side so that it does not interfere with the closure of the reversible securing means.

In preferred embodiments, the carrying aid may further comprise top and bottom layers (one such layer is at 301) of an additional material such as nylon, silk, or similar thin fabrics. If present, these fabric layers may be secured to the base carrying aid with adhesives or may be sewn in place. The fabric layers may comprise designs that are predominantly decorative, advertising materials, and computer-readable codes such as bar codes and QR codes which could allow a store to link the carrying aid with a loyalty program for repeat customers.

When in use, the carrying aid is placed in the loops of one or more t-shirt bag handles so the that midline longitudinal axis of the carrying aid is roughly aligned with the handle loops (501). The carrying aid's left side and the carrying id's right side are bent up and over the handle loops (501) and the reversible securing means (106/107) are engaged (401). The user may then wrap their fingers around the carrying carrying aid and lift the load. As the reversible securing means resists detachment, the carrying aid will not fall off of the handles when the bags are set down, as they may be when placed in a trunk or when set down to open a door. When the final destination is reached, the user may detach the reversible securing means and store the carrying aid.

I claim:

1. A carrying aid for carrying t-shirt bags by their handles comprising a largely rectangular and planar piece of a resilient material having a length and a width, said carrying aid further comprising a top face, a bottom face, a front side, a back side, a left side, a right side, and a midline longitudinal axis dividing the carrying aid into said left and right sides, said carrying aid's left side comprising a first segment of a two segment closure system, and said carrying aid's right side comprising a second segment of a two segment closure system, such that the carrying aid's said left side and said right side are capable of being folded towards each other and reversibly attached to each other, said carrying aid further comprising a strip of rigid material located on the midline longitudinal axis of the carrying aid, said strip comprising a longitudinal axis parallel to the carrying aid's longitudinal axis, a transverse axis, a rear terminus, a front terminus, a length along the strip's longitudinal axis, and a width along the strip's transverse axis, said rear terminus located in the carrying aid's back side, said front terminus located in the carrying aid's front side, said strip's length being substantially the same as the carrying aid's length, and said strip's width being less than one-third the width of the carrying aid.

* * * * *